United States Patent [19]

Burd

[11] 4,345,350

[45] Aug. 24, 1982

[54] PIPELINE CLEANING EQUIPMENT

[75] Inventor: John F. Burd, Newcastle upon Tyne, England

[73] Assignee: British Gas Corporation, London, England

[21] Appl. No.: 248,353

[22] Filed: Mar. 27, 1981

[30] Foreign Application Priority Data

Jan. 26, 1981 [GB] United Kingdom ..... 8102288

[51] Int. Cl.[3] ..... B08B 9/04

[52] U.S. Cl. ..... 15/104.06 R; 15/104.06 B; 209/215

[58] Field of Search ..... 15/104.06 R, 104.06 A, 15/104.06 B; 209/215, 223, 232; 210/222, 223

[56] References Cited

U.S. PATENT DOCUMENTS

| | | | |
|---|---|---|---|
| 3,292,197 | 12/1966 | Stephens | 15/104.06 R |
| 3,673,629 | 7/1972 | Casey | 15/104.06 R |
| 4,113,611 | 9/1978 | Gohm | 209/215 |

*Primary Examiner*—Edward L. Roberts

*Attorney, Agent, or Firm*—Watson, Cole, Grindle & Watson

[57] ABSTRACT

A pig for the removal of ferromagnetic debris from the internal surface of a pipeline comprises a plurality of large area pole pieces of hard ferromagnetic material mounted on low reluctance spacers so that the spacing of poles of opposite polarity is approximately equal to the spacing of the pole pieces from the nominal position of the internal surface of the pipeline.

7 Claims, 6 Drawing Figures

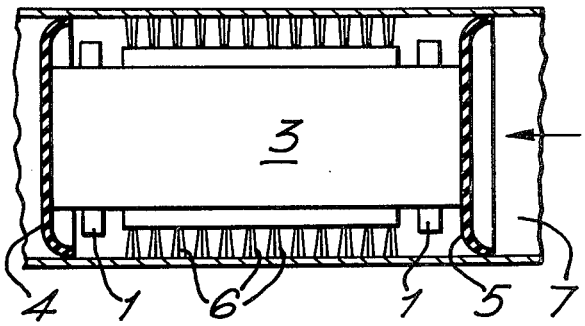
FIG.1.
(PRIOR ART)
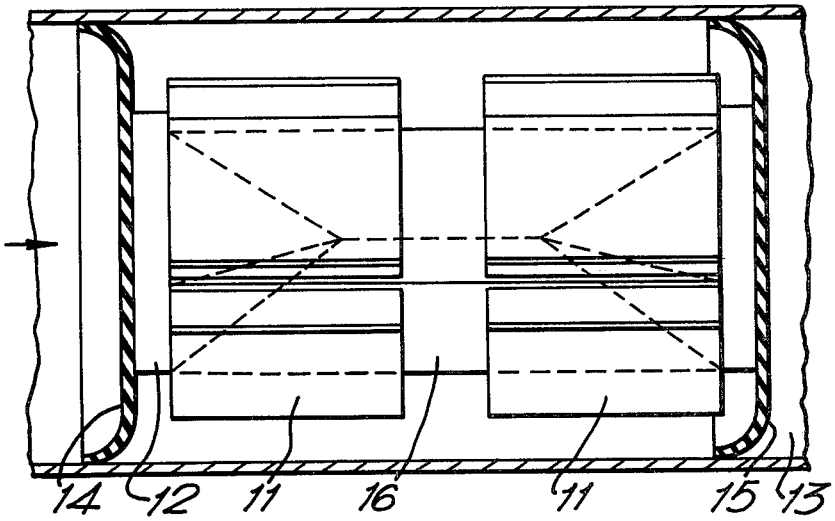
FIG.2.
FIG.3.
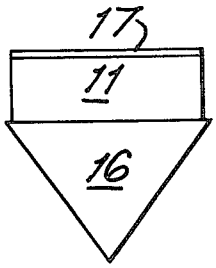

PIPELINE CLEANING EQUIPMENT

DESCRIPTION

This invention relates to pipeline cleaning equipment and, in particular, to pigs for removing ferromagnetic debris from the internal surface of pipelines.

Pigs or go-devils have a variety of uses in connection with the operation of pipelines used for the transport of fluids such as natural gas or oil. They may be used for inspecting the internal surface of the pipeline and, for this purpose, carry a variety of test equipment such as polarising magnets and magnetic field sensors, ultrasonic probes, contact styli or the like. Alternatively, they may serve as separators, being inserted when it is desired to pass a different fluid along the pipeline. Pigs of yet another form of construction serve to clean the pipeline and for this purpose carry brushes or scrapers to remove or loosen scale or other debris from the pipeline surface as they pass through.

Ferromagnetic material, such as welding rods or coupon can be difficult to remove from the pipeline by traditional means and it has proved necessary to construct a cleaning pig especially adapted to facilitate the removal of such material. Accordingly the present invention provides a pig for the removal of ferromagnetic debris from the internal surface of a pipeline comprising magnetic generating means for generating a plurality of large area magnetic poles, mounting means for said magnetic generating means to position said magnetic poles adjacent to but spaced apart from the internal surface of the pipeline, spacer means to provide substantial effective magnetic length and means for reducing the reluctance of the magnetic path between poles of opposite polarity.

An embodiment of the invention will now be described by way of example with reference to the accompanying drawings in which:

FIG. 1 is a schematic drawing of a prior art pipeline cleaning pig

FIG. 2 shows the arrangment of a magnetic cleaning pig in accordance with the present invention FIGS. 3 to 5 show details of the cleaning pig illustrated in FIG. 2.

Figure 4:
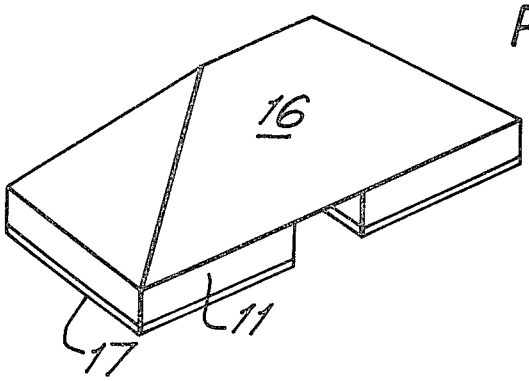

It is known, for example from U.K. Pat. No. 1397542 to incorporate magnetic pole pieces to generate a magnetic field on pigs used for cleaning pipelines. However, in this prior art arrangement, shown schematically in FIG. 1, the magnetic pole pieces 1,2 which are mounted on the body 3 of the pig adjacent the driver cups 4,5 and on either side of the cleaning brushes 6, are relatively small and serve only to generate a concentrated magnetic field which saturates and penetrates the ferromagnetic pipeline and provides a means of location should the pig become jammed in the pipeline 7 during a run.

Figure 5:
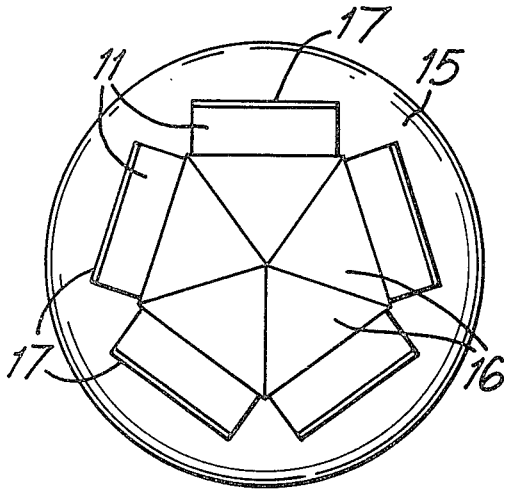

If the magnets carried by a pig are suitably configured, for example as shown in FIG. 2 of the drawings, they will act as scavengers of ferromagnetic material during passes of the pig through the pipeline. In the arrangement of FIG. 2 a plurality of magnetic pole pieces 11 of hard ferromagnetic material such as ferrite magnets are mounted on the body 12 of a cleaning pig which may be driven through a pipeline 13 by means of flexible cups 14,15. The pig body includes a plurality of roof-shaped spacer members 16 of soft iron which serve to provide a substantial effective length to the magnet structure between the pole pieces whilst reducing the effective reluctance of the magnetic path between pole pieces of opposite polarity. The pole pieces are provided with steel face plates 17 for mechanical protection. A plurality of pole pieces is mounted symetrically (FIG. 5) about the axis of the pig.

In one embodiment of the pig in accordance with the invention, the pole pieces were 150 mm×100 mm in area and those of opposite polarity were mounted on the body so that the spacing between them was 50 mm. The spacing of the centre of each pole piece from the nominal position of the internal surface of the pipeline was 50 mm, of the same order of magnitude as the spacing of pole pieces of opposite polarity from each other. The thickness of the pole pieces was 25 mm and of the steel face plates was 3 mm.

Figure 6:
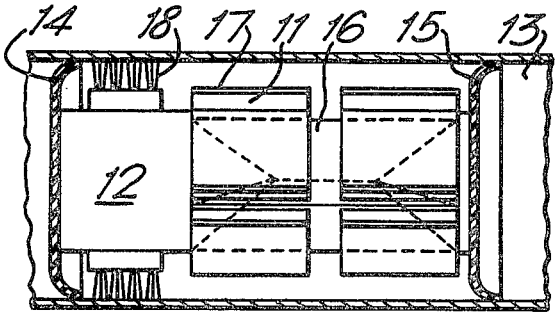
FIG. 6 is an illustration of a cleaning pig in accordance with a further embodiment of the invention.

Preferably the pig also carried agitating means such as brushes 18 mounted adjacent the pole pieces as shown in FIG. 6. These brushes agitate the debris before the pole pieces pass, causing more efficient capture of the debris. Scrapers may be used in place of the brushes.

It is advantageous if the pig rotates as it travels along the pipeline since debris tends to accumulate at the lowest part of the pipeline. If the pig rotates at, say, 1 rev/Km travelled, the pickup pole pieces will tend to be presented evenly to this region. Rotation may be effected by means of an off-axis wheel or by suitable disposition of agitator scrapers or brushes.

Conveniently the magnetic pole pieces are made of ferrite, but other magnetic materials suitable to withstand the environment whilst maintaining adequate magnetic strength, such as polymer-bonded samarium cobalt, may be used. Such environmental constraints might be shock, vibration, temperature or pressure.

The magnets should preferably be re-charged prior to a run to ensure that they are at maximum strength.

Preferably also the magnets are of sufficient strength to provide an adequate divergence of flux density in the region between the magnetised pipeline and the pole pieces of the assembly.

I claim:

1. A pig for the removal of ferromagnetic debris from the internal surface of a pipeline comprising magnetic pole generating means for generating a plurality of magnetic poles comprising blocks of hard ferromagnetic material, mounting means for said magnetic pole generating means to position said magnetic pole generating means adjacent to but spaced apart from the nominal position of the internal surface of the pipeline, spacer means contiguous with said mounting means to space magnetic poles of opposite polarity by a distance of the same order of magnitude as the spacing of said magnetic pole generating means from the nominal position of the internal surface of the pipeline.

2. A pig for the removal of ferromagnetic debris from the internal surface of a pipeline according to claim 1 wherein said hard ferromagnetic material is ferrite.

3. A pig for the removal of ferromagnetic debris from the internal surface of a pipeline according to claim 1 wherein said hard ferromagnetic material is polymer-bonded samarium cobalt.

4. A pig for the removal of ferromagnetic material from the internal surface of a pipeline according to claim 1 wherein said spacer means comprises roof-shaped blocks of soft magnetic material.

5. A pig according to claim 1 incorporating agitator means mounted adjacent to said magnetic pole generating means.

6. A pig according to claim 5 wherein said agitator means incorporates brushes.

7. A pig according to claim 5 wherein said agitator means incorporates scrapers.

* * * * *